US007802557B2

(12) United States Patent
Mattioli et al.

(10) Patent No.: US 7,802,557 B2
(45) Date of Patent: Sep. 28, 2010

(54) ELECTRONIC-INJECTION FUEL-SUPPLY SYSTEM

(75) Inventors: Massimo Mattioli, Castelmaggiore (IT); Paolo Pasquali, Castelmaggiore (IT); Luca Mancini, Budrio (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 11/973,785

(22) Filed: Oct. 10, 2007

(65) Prior Publication Data

US 2008/0141977 A1 Jun. 19, 2008

(30) Foreign Application Priority Data

Oct. 10, 2006 (EP) ..... 06425698

(51) Int. Cl.
*F02M 57/02* (2006.01)
*F02M 37/04* (2006.01)

(52) U.S. Cl. ..... 123/446; 123/497; 123/499

(58) Field of Classification Search ..... 123/446, 123/495, 497, 499; 417/417, 549, 552, 555.1
See application file for complete search history.

(56) References Cited

U.S. PATENT DOCUMENTS 5,209,260 A * 5/1993 Baek ..... 137/527
5,454,397 A * 10/1995 Miszczak ..... 137/512
5,980,219 A * 11/1999 Spurny ..... 417/296
6,223,724 B1 * 5/2001 Miyaji et al. ..... 123/446
6,314,990 B1 * 11/2001 Brabek et al. ..... 137/454.4
6,461,126 B1 * 10/2002 Pierobon ..... 417/569
6,540,492 B2 * 4/2003 Kaido et al. ..... 417/562
6,575,718 B2 * 6/2003 Onishi et al. ..... 417/571
7,191,961 B2 * 3/2007 Okamoto et al. ..... 239/533.12
2003/0116135 A1 * 6/2003 Hashimoto et al. ..... 123/446
2008/0141977 A1 * 6/2008 Mattioli et al. ..... 123/446

FOREIGN PATENT DOCUMENTS

EP 1306544 5/2003
EP 1460261 9/2004
EP 1724467 11/2006
WO WO2006/035298 4/2006

OTHER PUBLICATIONS

European Search Report dated Mar. 14, 2007 based on EP application No. EP06425698.

* cited by examiner

*Primary Examiner*—Stephen K Cronin
*Assistant Examiner*—Sizo B Vilakazi
(74) *Attorney, Agent, or Firm*—Ohlandt, Greeley, Ruggiero and Perle, L.L.P.

(57) ABSTRACT

Described herein is an electronic-injection fuel-supply system for an internal-combustion engine having at least one injector and a fuel pump; the fuel pump is provided with: a variable-volume pumping chamber; a one-way intake valve; a one-way delivery valve; a mobile piston that integrates within it the intake valve and is coupled to the pumping chamber to vary cyclically the volume of the pumping chamber itself; and an actuator device that impresses a reciprocating motion on the piston and has an electromagnetic actuator for actuating the piston during an intake phase and a spring for actuating the piston during a delivery phase.

19 Claims, 5 Drawing Sheets

ELECTRONIC-INJECTION FUEL-SUPPLY SYSTEM

TECHNICAL FIELD

The present invention relates to an electronic-injection fuel-supply system.

The present invention finds advantageous application in an internal-combustion engine with small displacement for motor vehicles, to which the ensuing treatment will make explicit reference, without this implying any loss of generality.

BACKGROUND ART

In order to be able to respect the increasingly restrictive limits of emission imposed by recent anti-pollution standards, also in internal-combustion engines with small displacement (even just 50 cc) for motor vehicles it is necessary to use electronic-injection fuel supply instead of traditional supply to carburettors.

In an electronic-injection fuel-supply system for an internal-combustion engine with small displacement, an electrically actuated fuel pump draws the fuel from a tank at atmospheric pressure and supplies it to the injector. It is necessary for the fuel pump to have a very low electric-power absorption compatible with the electric power generated by the electric generator when the internal-combustion engine is idling.

The amount of fuel that is injected by an injector is a function both of the injection time (i.e., of the interval of time in which the injector is kept open) and of the fuel-supply pressure. Consequently, when the electronic-injection fuel supply is used, it is necessary to guarantee that the fuel-supply pressure is constant and equal to a predetermined design value.

In known internal-combustion engines with small displacement, a high-efficiency fuel pump is used (to keep the electric-power absorption low) with constant flow rate of fuel associated to a pressure regulator, which keeps the fuel-supply pressure constant and equal to the predetermined design value. Consequently, the fuel pump supplies to the injector a flow rate of fuel that is always constant irrespective of the engine r.p.m., and the pressure regulator recycles the excess fuel to the tank to keep the fuel-supply pressure constant and equal to the predetermined design value.

In other words, the fuel pump is sized to supply in each condition of operation an amount of fuel exceeding the effective consumption, and provided downstream of the fuel pump is the pressure regulator, which keeps the value of the fuel-supply pressure constant and equal to the predetermined design value, discharging the excess fuel towards a recalculation channel that sends the excess fuel back into the tank. In this case, the fuel pump must be sized to supply an amount of fuel equal to the maximum consumption possible. However, said condition of maximum consumption possible occurs rather seldom, and in all the remaining conditions of operation the amount of fuel supplied by the fuel pump is much greater than the actual consumption, and hence a considerable portion of said fuel must be discharged by the pressure regulator into the tank.

It is evident that the work performed by the fuel pump to pump the fuel that is subsequently discharged by the pressure regulator is "useless" work. Consequently, the electronic-injection fuel-supply system has as a whole a very low energetic efficiency. Furthermore, the pressure regulator and the recirculation channel connected to the pressure regulator are rather cumbersome and increase the overall costs of the electronic-injection fuel-supply system.

In an internal-combustion engine with small displacement, the high consumption of electrical energy is particularly burdensome during idling, in so far as during idling the electric-current generator of the engine has a modest capacity of generation. Consequently, during idling the operation of the fuel pump may be irregular owing to lack of an adequate electric power, and hence also the fuel injection and combustion may be irregular.

EP1306544A1 discloses an electronically controlled fuel injection device constructed from a plunger pump, a circulation passage which circulates fuel that has been pressurized in the initial region of the pressure-feeding stroke, a valve body which blocks the circulation passage in the later region of the pressure-feeding stroke, an inlet orifice nozzle which allows the passage of fuel whose pressure has been increased in the later region of the pressure-feeding stroke, an outlet orifice nozzle which is used to circulate some of the fuel that has passed through the inlet orifice nozzle back into the fuel tank, an injection nozzle which injects an amount of fuel equal to the difference between the fuel that has passed through the inlet orifice nozzle and the fuel that has passed through the outlet orifice nozzle, and control means for controlling the plunger pump in response to the cycle of the engine.

DISCLOSURE OF INVENTION

The aim of the present invention is to provide an electronic-injection fuel-supply system, said supply system being free from the drawbacks described above and, in particular, easy and inexpensive to produce.

Provided according to the present invention is an electronic-injection fuel-supply system as claimed in the attached Claims.

BRIEF DESCRIPTION OF THE DRAWINGS

The present invention will now be described with reference to the annexed plate of drawings, which illustrates some non-limiting examples of embodiment thereof, and in which.

PREFERRED EMBODIMENTS OF THE INVENTION

Figure 1:
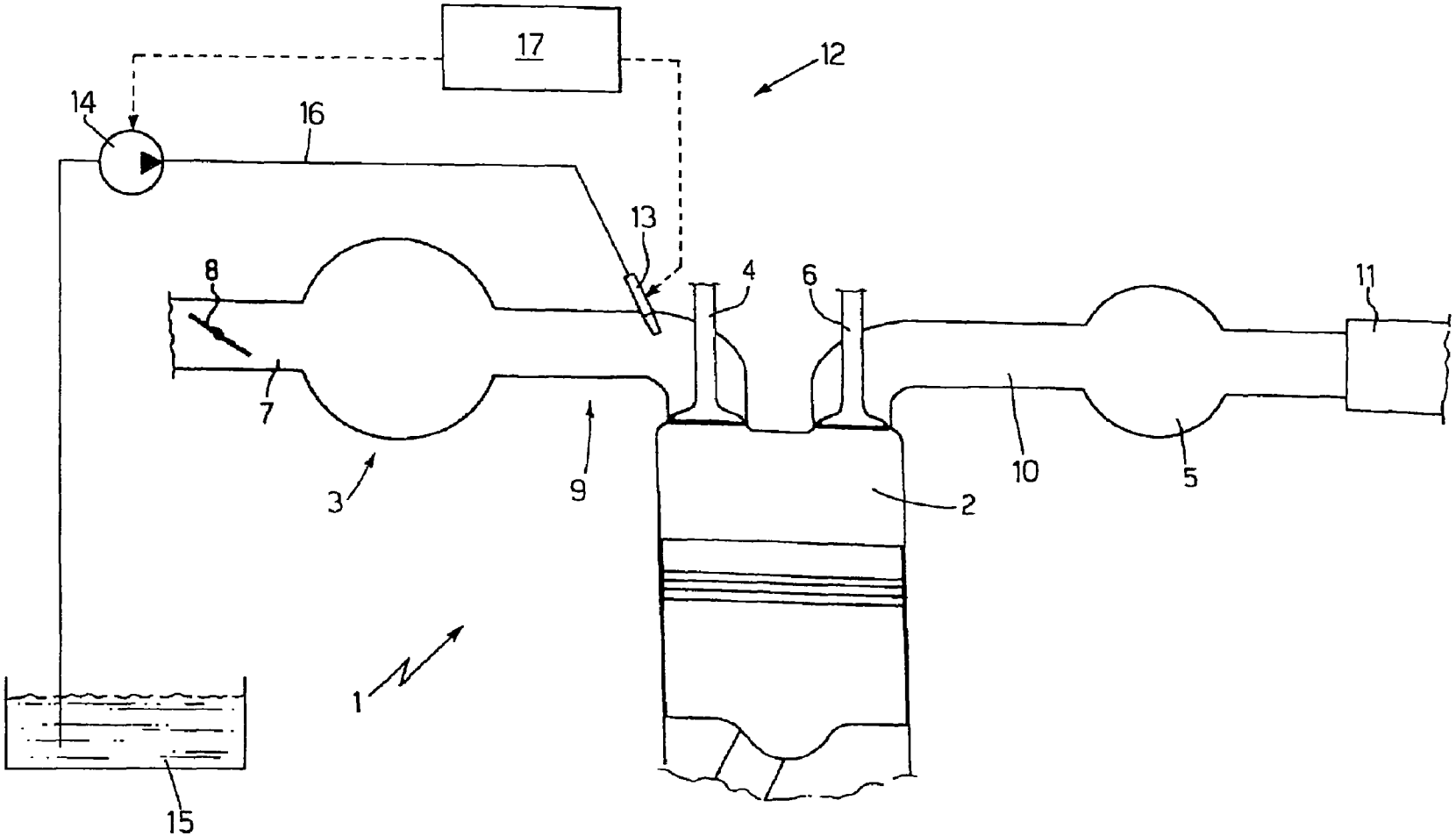
FIG. 1 is a schematic view of an internal-combustion engine provided with an electronic-injection fuel-supply system built in accordance with the present invention.

In FIG. 1, number 1 designates as a whole an internal-combustion engine provided with a cylinder 2, which is connected to an intake manifold 3 via at least one intake valve 4 and to an exhaust manifold 5 via at least one exhaust valve 6.

The intake manifold 3 receives fresh air (i.e., air coming from the external environment) through a supply pipe 7 regulated by a throttle valve 8 and is connected to the cylinder 2 by means of an intake pipe 9, which is regulated by the intake valve 4. Likewise, the exhaust manifold 5 is connected to the cylinders 2 by means of an exhaust pipe 10, which is regulated by the exhaust valve 6. Departing from the exhaust manifold 5 is an emission pipe 11, which terminates with a silencer (known and not illustrated) for emitting the gases produced by the combustion into the atmosphere.

The fuel (normally petrol or LPG) is supplied to the cylinder 2 by means of an electronic-injection fuel-supply system 12, which comprises an injector 13 set in the proximity of the intake valve 4 for injecting the fuel itself within the intake pipe 9. According to a different embodiment (not illustrated), the injector 12 is set so as to inject the fuel directly within the cylinder 2. The electronic-injection fuel-supply system 12 further comprises a fuel pump 14, which draws the fuel from a tank 15 at atmospheric pressure and supplies it to the injector 13. The fuel pump 14 is connected hydraulically to the injector 13 by means of a connection pipe 16, which constitutes an elastic accumulator. Preferably, the connection pipe 16 comprises at least one portion constituted by a pipe made of elastic material (rubber or the like) that defines the elastic accumulator. Alternatively, the connection pipe 16 could be made entirely of rigid material and could comprise an independent elastic accumulator.

An electronic control unit 17 regulates operation of the electronic-injection fuel-supply system 12 and in particular drives the injector 13 for injecting the fuel cyclically during the intake phases of the piston and drives the fuel pump 14 for supplying the fuel to the injector 13 with a constant and predetermined pressure.

Figure 2:
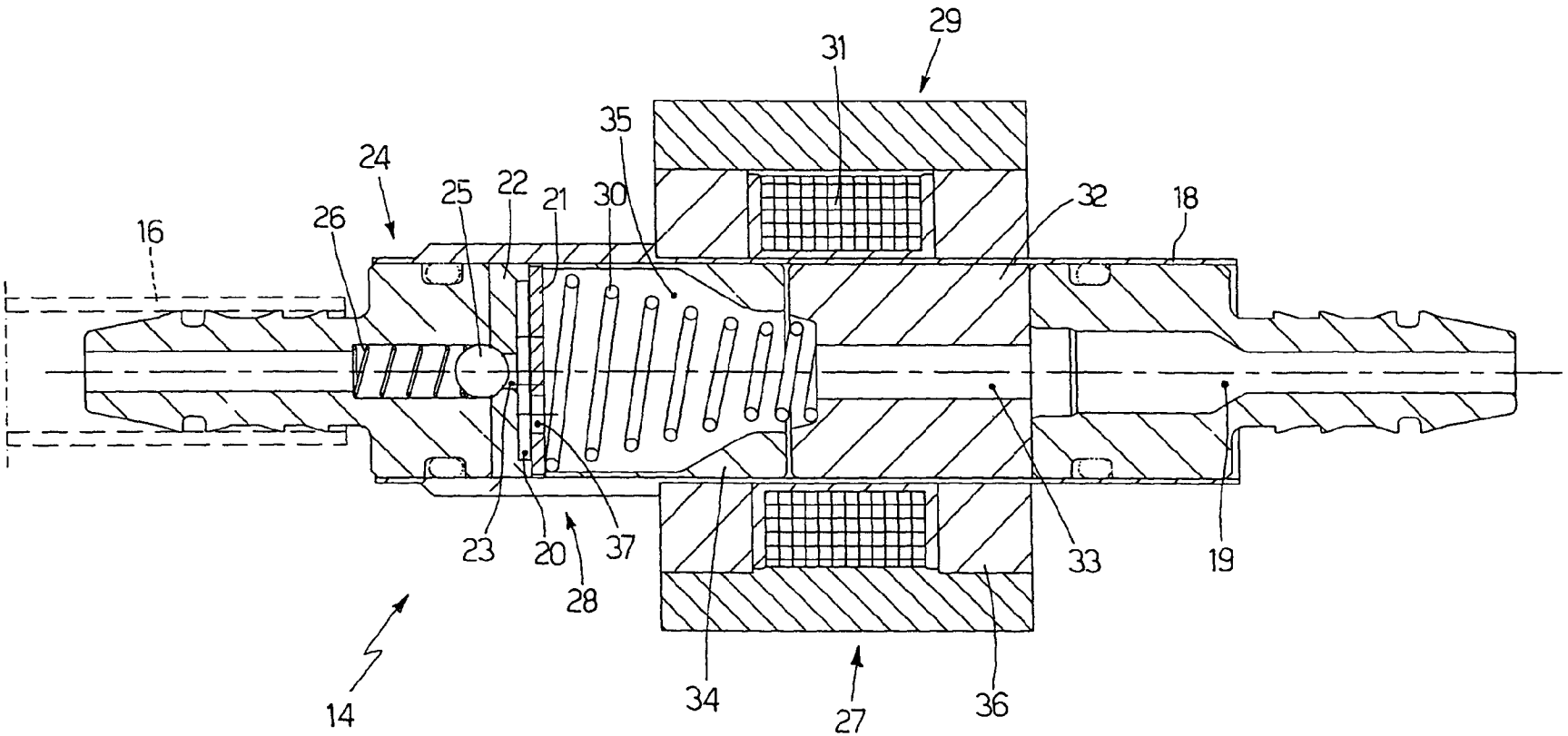
FIG. 2 is a cross-sectional view with parts removed for reasons of clarity of a fuel pump of the supply system of FIG. 1.
Figure 3:
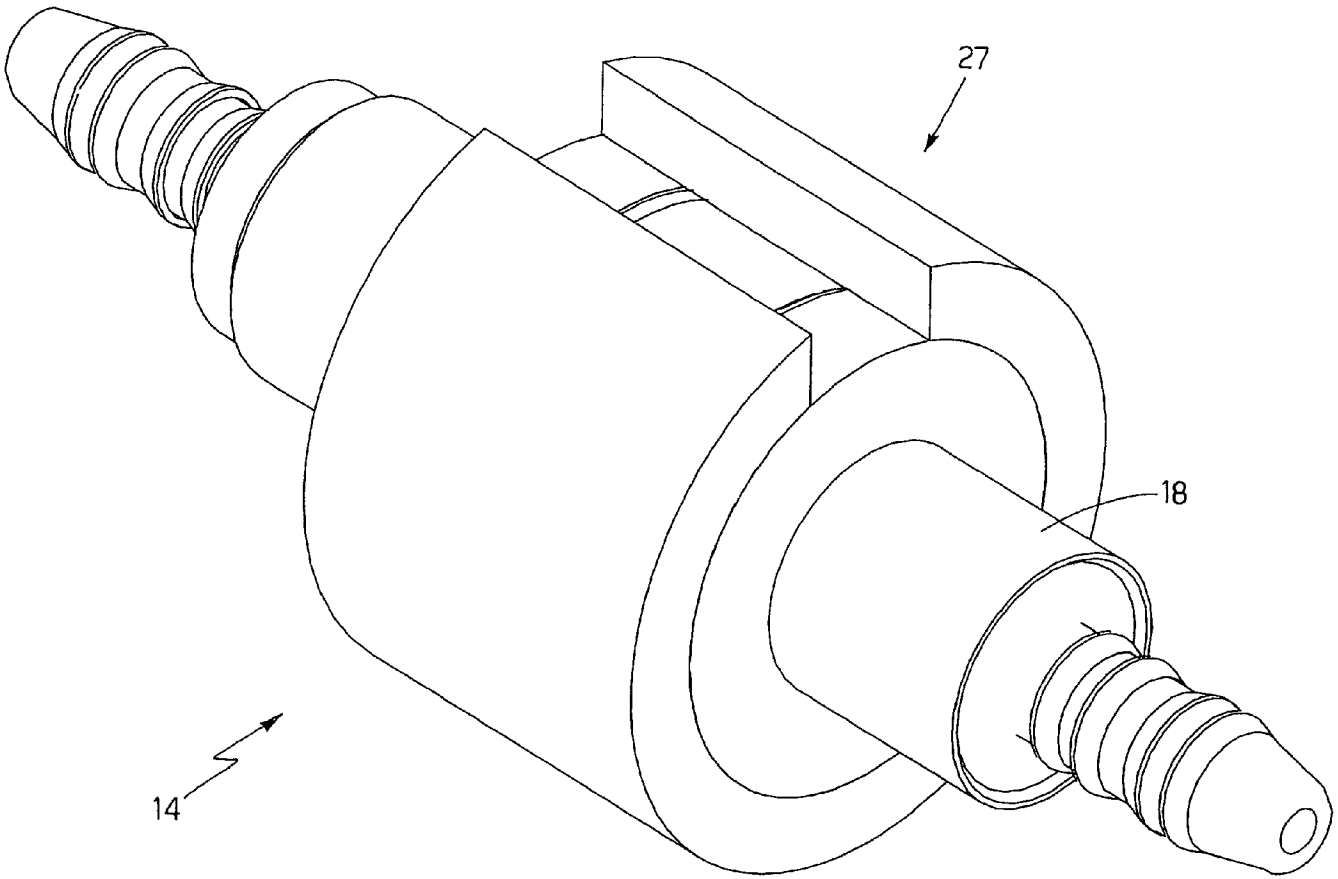
FIG. 3 is a perspective schematic view of the fuel pump of FIG. 2.
Figure 4:
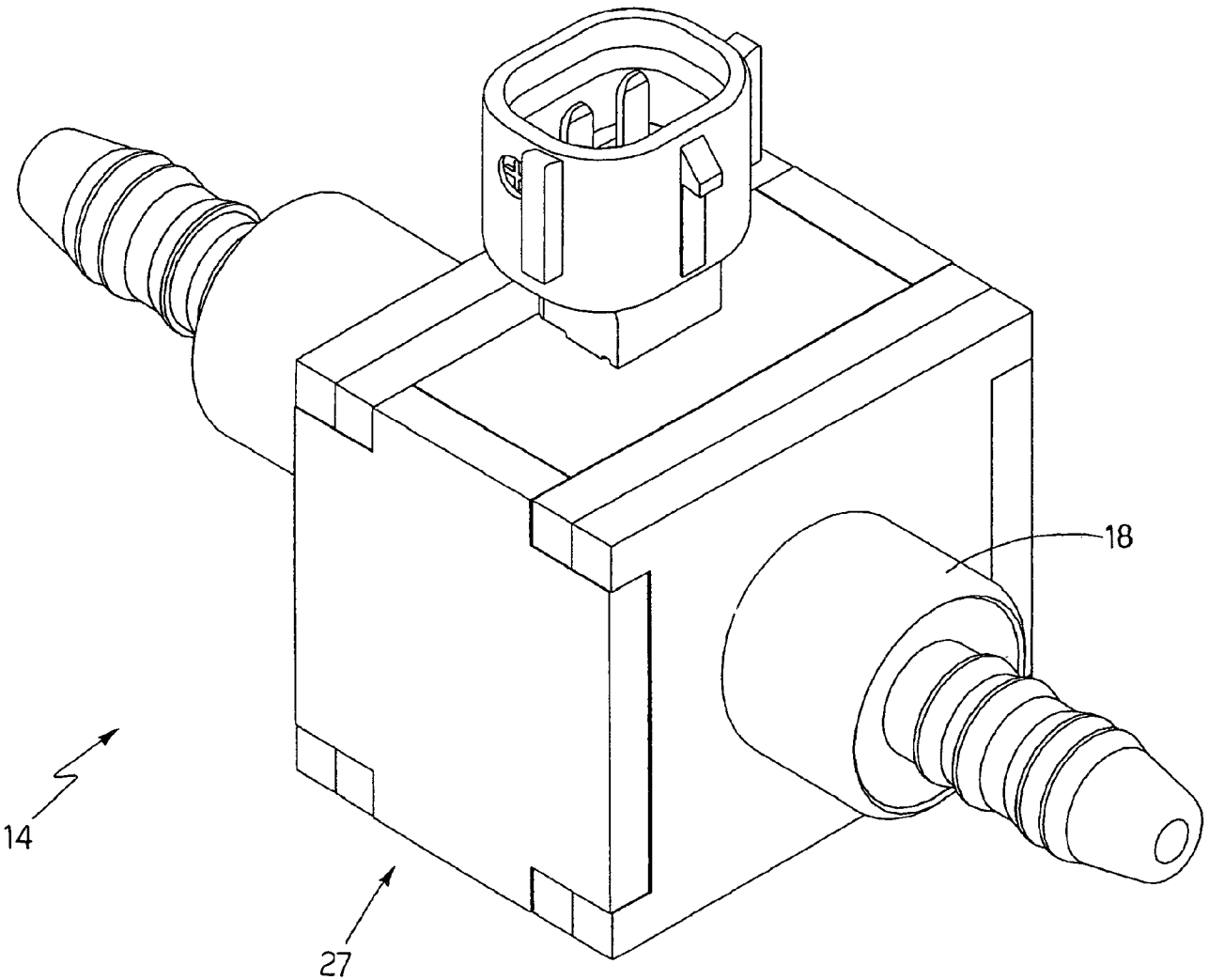
FIG. 4 is a perspective schematic view of a different embodiment of the fuel pump of FIG. 2.

According to what is illustrated in FIG. 2, the fuel pump 14 comprises a cylindrical tubular housing body 18 having a central supply channel 19, which is connected, on one side, to the fuel tank 15 and, on the opposite side, to the injector 13 by means of the connection pipe 16.

Defined within the housing body 18 and along the supply channel 19 is a variable-volume pumping chamber 20, which has a cylindrical shape, is delimited at the sides by the housing body 18, and is delimited axially by a mobile piston 21, and by a fixed closing disk 22 having a through delivery hole 23 engaged by a one-way delivery valve 24 that regulates exit of the fuel from the pumping chamber 20. Preferably, the delivery valve 24 is a ball valve and comprises a spherical open/close element 25, which is pushed against a mouth of the delivery hole 23 by a valve spring 26.

The piston 21 is actuated by an actuator device 27, which in use impresses on the piston 21 itself a reciprocating movement to vary cyclically the volume of the pumping chamber 20. The piston 21 integrates within it a one-way intake valve 28, which regulates supply of the fuel to the pumping chamber 20.

The actuator device 27 comprises an electromagnetic actuator 29 for actuating the piston 21 during an intake phase and a spring 30 for actuating the piston 21 during a delivery phase. In other words, during the intake phase, the electromagnetic actuator 29 is excited for displacing the piston 21 in a first direction so as to increase the volume of the pumping chamber 20, against the force exerted by the spring 30. At the end of the intake phase, the electromagnetic actuator 29 is de-energized, and the piston 21 is displaced in a second direction opposite to the first direction so as to reduce the volume of the pumping chamber 20 by the elastic force exerted by the spring 30.

According to a preferred embodiment, the spring 30 is sized so that the force of pre-loading exerted by the spring 30 on the piston 21 is equal to the useful area of the piston 21 (i.e., to the circular surface of the piston 21 that delimits the pumping chamber 20) multiplied by the desired fuel-supply pressure. In this way, the spring 30 is able to push the fuel out of the pumping chamber 21 through the delivery valve 24 and towards the connection pipe 16 giving out into the injector 13 only if the pressure of the fuel within the connection pipe 16 is lower than the desired fuel-supply pressure. Otherwise, the system is in equilibrium; i.e., the thrust exerted by the spring 30 on the fuel present in the pumping chamber 20 is equal to the opposite thrust exerted by the fuel present in the connection pipe 16. Hence, the delivery valve 24 does not open, and the piston 21 remains stationary. It is important to emphasize that in the sizing proposed above of the spring 30 the contribution of the valve spring 26 has been neglected in so far as the elastic force exerted by the valve spring 26 is much smaller than the elastic force exerted by the spring 30.

The electromagnetic actuator 29 comprises a coil 31, a fixed magnetic pole 32, which is set within the housing body 18, and has a central hole 33 to enable flow of the fuel along the supply channel 19, and a mobile anchor 34, which is set within the housing body 18, has a central hole 35 to enable flow of the fuel along the supply channel 19, is rigidly connected to the piston 21, and is designed to be magnetically attracted by the magnetic pole 32 when the coil 31 is excited.

According to a preferred embodiment, the coil 31 is set externally around the housing body 18 and is hence isolated from the fuel (solution referred to commercially as "dry coil"). In this way, the isolation of the coil 31 does not have to be fluid-tight and does not have to resist the corrosion generated by the fuel and hence can be much simpler and less expensive than an equivalent isolation that is to come into contact with the fuel.

Furthermore, the electromagnetic actuator 29 comprises a tubular magnetic armature 36, which is set on the outside of the housing body 18 and comprises a seat for housing within it the coil 31.

Preferably, the spring 30 is set within the central hole 35 of the mobile anchor 34 and is compressed between the fixed magnetic pole 32 and the piston 21. Furthermore, the spring 30 preferably has a conical shape having the base greater in a position corresponding to the piston 21 to simplify assembly of the spring 30 itself.

Figure 5:
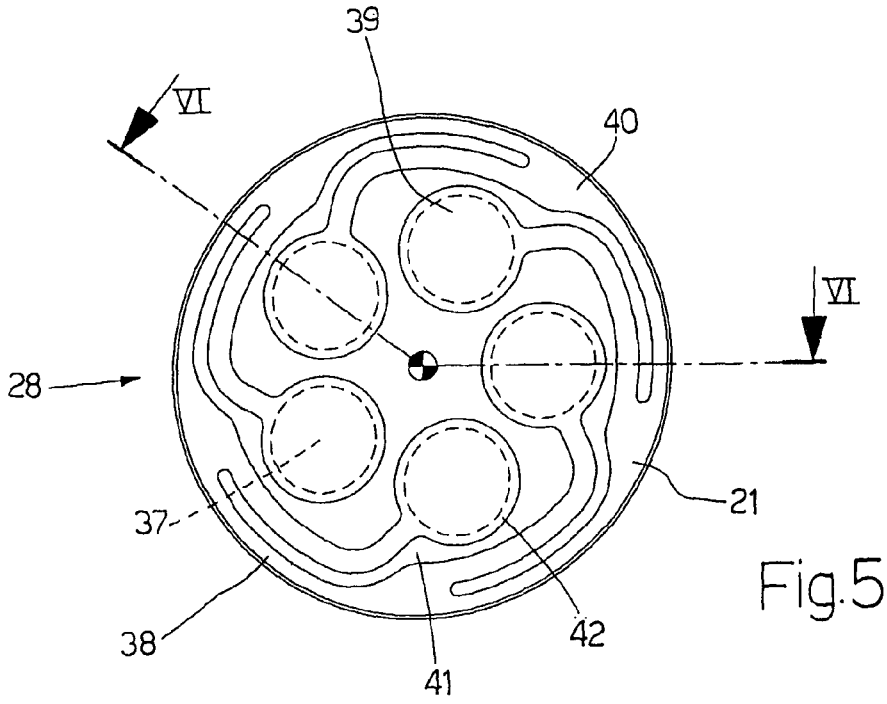
FIG. 5 is a plan view from beneath of an intake valve of the fuel pump of FIG. 2.
Figure 6:
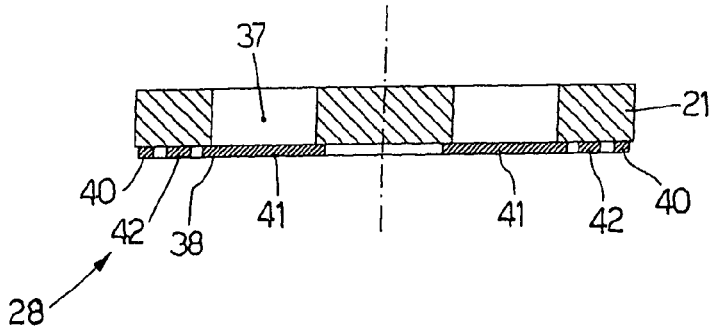
FIG. 6 is a longitudinal side view in cross section according to the line VI-VI of the intake valve of FIG. 5.
Figure 7:
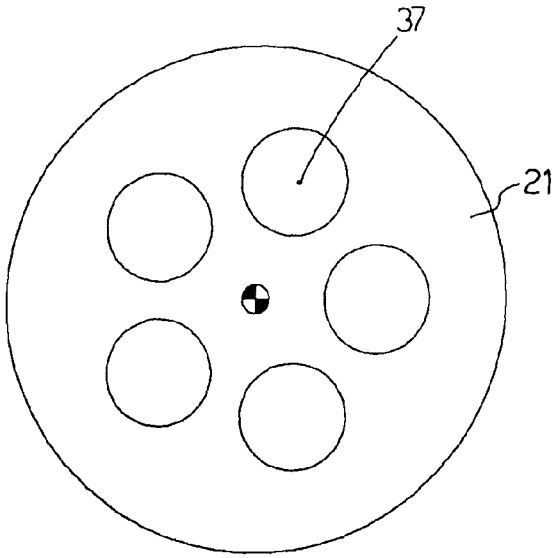
FIG. 7 is a plan view from above of the intake valve of FIG. 5.

According to what is illustrated in FIGS. 5, 6 and 7, the piston 21 is constituted by a thin disk and is provided with a plurality of through supply holes 37. The intake valve 28 comprises a deformable lamina 38 fixed to the piston 21 in a position corresponding to a peripheral edge thereof and provided with a series of petals 39 (illustrated in detail in FIGS. 5 and 6), each of which is coupled to a respective supply hole 37. Normally, each petal 39 of the lamina 38 is set in a position of closing of the supply hole 37 and is mobile, during the forward stroke of the piston 21, from the position of closing to a position of opening of the supply hole 37 itself to enable inlet of the petrol into the pumping chamber 20.

According to what is illustrated in FIGS. 5, 6 and 7, the lamina 38 of the intake valve 14 comprises an outer ring 40, which is fixed to the piston 21 by means of welding (preferably by means of laser spot welding). Extending from the ring 40 towards the inside are petals 39, each of which comprises a seal element 41 of circular shape connected to the ring 40 by means of a thin stem 42, i.e., having a length much greater than the width so as to enable its elastic deformation. Consequently, each seal element 41 is set in a position of closing of the supply hole 37 as a result of the elastic thrust generated by the stem 42. During the intake stroke of the piston 21, the pressure of the petrol along the supply channel 19 acts on each seal element 41, bringing about an elastic deformation of the stem 42 and hence displacement of the seal element 41 from the position of closing to a position of opening of the supply hole 37 to enable inlet of the petrol into the pumping chamber 20.

According to a preferred embodiment, the deformable lamina 38 is obtained starting from a sheet of elastic steel that is processed by means of photo-etching; subsequently, the deformable lamina 38 is connected to the piston 21 processed by means of pressing using laser spot welding.

According to the embodiment illustrated in FIGS. 5, 6 and 7, each seal element 41 is connected to the outer ring 40 by means of a stem 42 of its own. According to a different embodiment (not illustrated), some seal elements 41 are connected to the outer ring 40 by means of a stem 42 of their own, whilst other seal elements 41 are not connected directly to the outer ring 40, but are connected to the seal elements 41 that are connected directly to the outer ring 40.

The intake valve 28 described above has a high permeability and a short response time. In fact, the presence of a high number of supply holes 37 and of respective petals 39 enables a high permeability to be obtained together with a very small mobile mass. Consequently, the intake valve 28 described above is particularly suited to being used in the fuel pump 14, for which a high speed of response and a high permeability in the presence of contained pressure jumps is required.

During normal operation of the electronic-injection fuel-supply system 12, the control unit 17 drives the injector 13 with a first command depending upon the engine point and drives the actuator device 27 of the fuel pump 14 with a second command, which is synchronous with the first command for driving the injector 13. In other words, whenever the control unit 17 actuates the injector 13, the control unit 17 actuates also the fuel pump 14. In this way, the fuel pump 14 is actuated only when it is actually necessary (i.e., when the injector 13 injects the fuel), and hence useless actuation of the fuel pump 14 with a consequent waste of energy is avoided. It is important to note that, when the internal-combustion engine 1 is idling, the frequency of injection (i.e., the frequency with which the injector 13 is driven) is low (even 1/10 of the frequency of injection at maximum r.p.m.), and consequently also the frequency for driving the actuator device 27 of the fuel pump 14 is low, and hence the consumption of electrical energy of the actuator device 27 itself is low.

According to a preferred embodiment, the duration of the second command for driving the actuator device 27 of the fuel pump 14 is a function of a battery voltage, of a temperature of the internal-combustion engine 1 (in particular of a temperature of a coolant of the internal-combustion engine 1), and of an injection time (i.e., of the interval of time for which the injector 13 is kept open).

In a starting stage of the internal-combustion engine 1, the control unit 17 actuates repeatedly and rapidly the actuator device 27 of the fuel pump 14 to pressurize the connection pipe 16. Once the connection pipe 16 has been pressurized, the control unit 17 drives the actuator device 27 of the fuel pump 14 in a synchronous way with the injector 13, as described previously.

The electronic-injection fuel-supply system 12 described above presents numerous advantages in so far as it is simple and inexpensive to produce, has extremely contained overall dimensions (also on account of the absence of an external pressure regulator), enables very precise regulation of the fuel-supply pressure, and has a very high energetic efficiency (i.e., a low consumption of electrical energy, particularly when the internal-combustion engine 1 is idling).

The invention claimed is:

1. An electronic-injection fuel-supply system for an internal-combustion engine that comprises at least one injector having a desired fuel-supply pressure, a fuel pump, and a connection pipe connecting the fuel pump hydraulically to the at least one injector; the fuel pump comprising:

a variable-volume pumping chamber;

a one-way intake valve;

a one-way delivery valve;

a mobile piston is coupled to the variable-volume pumping chamber to vary cyclically the volume of the variable-volume pumping chamber and the piston integrates within it the one-way intake valve; and an electromagnetic actuator device, which impresses a reciprocating motion on the piston, comprises an electromagnetic actuator for actuating the piston during an intake phase, and comprises a spring for actuating the piston during a delivery phase, wherein the electromagnetic actuator comprises: a coil; a fixed magnetic pole, which is set within a housing body and has a central hole to enable flow of fuel along a central supply channel of the housing body; and a mobile anchor, which is set within the housing body and has a central hole to enable flow of the fuel along the supply channel, is rigidly connected to the piston and is designed to be magnetically attracted by the fixed magnetic pole when the coil is excited, wherein the spring is sized so that the force of pre-loading exerted by the spring on the piston is equal to the useful area of the piston multiplied by the desired fuel-supply pressure so that the spring is able to push the fuel out of the variable-volume pumping chamber through the one-way delivery valve and towards the connection pipe giving out into the at least one injector only if a pressure of fuel within the connection pipe is lower than the desired fuel-supply pressure, and wherein the spring is set within the central hole of the mobile anchor and is compressed between the fixed magnetic pole and the piston.

2. The fuel-supply system according to claim 1, further comprising a control unit, which drives the injector with a first command depending upon an engine point and drives the electromagnetic actuator device of the fuel pump with a second command, which is synchronous with the first command for driving the injector.

3. The fuel-supply system according to claim 2, wherein the duration of the second command for driving the electromagnetic actuator device of the fuel pump is a function of a battery voltage, of a temperature of the internal-combustion engine, and of an injection time.

4. The fuel-supply system according to claim 2, wherein the connection pipe is an elastic accumulator.

5. The fuel-supply system according to claim 4, wherein the connection pipe comprises at least one portion constituted by a pipe made of elastic material that defines the elastic accumulator.

6. The fuel-supply system according to claim 4, wherein, in a starting stage of the internal-combustion engine, the control unit actuates repeatedly and rapidly the electromagnetic actuator device of the fuel pump to pressurize the connection pipe.

7. The fuel-supply system according to claim 1, wherein the housing body is a cylindrical tubular housing body, and wherein the fuel pump comprises the cylindrical tubular housing body having the central supply channel, which is connected, on one side, to a fuel tank and, on the opposite side, to the injector and defines within it the variable-volume pumping chamber.

8. The fuel-supply system according to claim 7, wherein the variable-volume pumping chamber has a cylindrical shape, is delimited at the sides by the cylindrical tubular housing body, and is delimited axially by the piston provided with the one-way delivery valve, and by a fixed closing disk having a through delivery hole engaged by the one-way delivery valve.

9. The fuel-supply system according to claim 8, wherein the one-way delivery valve is a ball valve and comprises a spherical open/close element that is pushed against a mouth of the delivery hole by a valve spring.

10. The fuel-supply system according to claim 1, wherein the coil is set externally around the housing body.

11. The fuel-supply system according to claim 10, wherein the electromagnetic actuator comprises a tubular magnetic armature, which is set on the outside of the housing body and comprises a seat for housing within it the coil.

12. The fuel-supply system according to claim 1, wherein the spring has a conical shape that increases in diameter toward a major base facing the piston.

13. The fuel-supply system according to claim 1, wherein the piston is constituted by a thin disk and is provided with a plurality of through supply holes;

wherein the one-way intake valve comprises a deformable lamina fixed to the piston in a position corresponding to a peripheral edge thereof and provided with a series of petals, each of which is coupled to a respective supply hole; and wherein each petal of the lamina is set in a position of closing of the supply hole and is mobile, during the forward stroke of the piston, from the position of closing to a position of opening of the supply hole to enable inlet of the fuel into the pumping chamber.

14. The fuel-supply system according to claim 13, wherein the lamina of the one-way intake valve comprises an outer ring, which is fixed to the piston; extending from the outer ring of the lamina towards the inside are petals, each of which comprises a seal element of circular shape.

15. The fuel-supply system according to claim 14, wherein the petals are connected to the outer ring by a plurality of thin stems.

16. The fuel-supply system according to claim 14, wherein each seal element is connected to the ring by a respective thin stem.

17. The fuel-supply system according to claim 14, wherein some seal elements have a stem that connects said same seal elements to the outer ring, while other seal elements are not connected directly to the outer ring, but are connected to the seal elements that are connected directly to the outer ring.

18. An electronic-injection fuel-supply system for an internal-combustion engine that comprises at least one injector and a fuel pump; the fuel pump comprising:

a variable-volume pumping chamber;

a one-way intake valve;

a one-way delivery valve;

a mobile piston is coupled to the variable-volume pumping chamber to vary cyclically the volume of the pumping chamber and the piston integrates within it the one-way intake valve; and an actuator device, which impresses a reciprocating motion on the piston, comprises an electromagnetic actuator for actuating the piston during an intake phase, and comprises a spring for actuating the piston during a delivery phase, wherein the electromagnetic actuator comprises: a coil; a fixed magnetic pole, which is set within a housing body and has a central hole to enable flow of fuel along a central supply channel of the housing body; and a mobile anchor, which is set within the housing body, has a central hole to enable flow of the fuel along the central supply channel, is rigidly connected to the piston, and is designed to be magnetically attracted by the fixed magnetic pole when the coil is excited, wherein the spring is sized so that a force of pre-loading exerted by the spring on the piston is equal to a useful area of the piston multiplied by a desired fuel-supply pressure, wherein the spring is set within the central hole of the mobile anchor and is compressed between the fixed magnetic pole and the piston.

19. The fuel-supply system according to claim 18, wherein the spring has a conical shape that increases in diameter toward a major base facing the piston.

* * * * *